US008387582B2

(12) United States Patent
Shin et al.

(10) Patent No.: US 8,387,582 B2
(45) Date of Patent: Mar. 5, 2013

(54) OIL DISCHARGING STRUCTURE FOR BALANCE SHAFT MODULE

(75) Inventors: Minsig Shin, Gyeonggi-Do (KR); Gabseok Ko, Gyeonggi-Do (KR); Myungrae Cho, Incheon (KR); Hongwook Lee, Gyeonggi-Do (KR); Wootae Kim, Gyeonggi-Do (KR); Jinwoo Cho, Seongnam (KR)

(73) Assignees: Kia Motors Corporation, Seoul (KR); Hyundai Motor Company, Seoul (KR)

( * ) Notice: Subject to any disclaimer, the term of this patent is extended or adjusted under 35 U.S.C. 154(b) by 637 days.

(21) Appl. No.: 12/625,833

(22) Filed: Nov. 25, 2009

(65) Prior Publication Data

US 2010/0139605 A1 Jun. 10, 2010

(30) Foreign Application Priority Data

Dec. 5, 2008 (KR) ..... 10-2008-0123071

(51) Int. Cl.
*F02B 75/06* (2006.01)

(52) U.S. Cl. ..... 123/192.2; 123/196 R

(58) Field of Classification Search ..... 123/192.1, 123/192.2, 196 R; *F02B 75/06*
See application file for complete search history.

(56) References Cited

U.S. PATENT DOCUMENTS

| | | | | |
|---|---|---|---|---|
| 6,079,383 | A * | 6/2000 | Shirai et al. | 123/192.2 |
| 6,725,974 | B2 * | 4/2004 | Sato et al. | 184/106 |
| 6,752,117 | B2 | 6/2004 | Purcell et al. | |
| 6,880,512 | B2 * | 4/2005 | Hashimoto et al. | 123/192.2 |

FOREIGN PATENT DOCUMENTS

| | | | |
|---|---|---|---|
| JP | 2000-088059 | A | 3/2000 |
| JP | 2002-070950 | A | 3/2002 |
| JP | 2008175137 | A * | 7/2008 |

* cited by examiner

*Primary Examiner* — Noah Kamen
*Assistant Examiner* — Hung Q Nguyen
(74) *Attorney, Agent, or Firm* — Edwards Wildman Palmer LLP; Peter F. Corless

(57) ABSTRACT

An oil discharging structure of a balance shaft module smoothly discharging oil pumped by a balance shaft outside of the balance shaft module by forming an oil guide surface in a ladder frame that is installed in an upper part of the balance shaft module. The oil discharging structure of the present invention preferably includes a balance shaft housing that is rotatably supported with a balance shaft inserted therein; oil discharge holes formed in the balance shaft housing so that oil in the balance shaft housing is discharged to the outside by the balance shaft; and an oil guiding portion that is provided in a ladder frame mounted on an upper part of the balance shaft housing in order to induce the oil discharged through the oil discharge holes to the outside of the balance shaft housing.

10 Claims, 5 Drawing Sheets

OIL DISCHARGING STRUCTURE FOR BALANCE SHAFT MODULE

CROSS-REFERENCE TO RELATED APPLICATIONS

The present application is based on, and claims priority from, Korean Application Serial Number 10-2008-0123071, filed on Dec. 5, 2008, the disclosure of which is hereby incorporated by reference herein in its entirety.

FIELD OF THE INVENTION

The present invention relates, in general, to a balance shaft module used for a vehicle, and more particularly, to an oil discharging structure for a balance shaft module that can smoothly discharge oil pumped by a balance shaft.

BACKGROUND OF THE INVENTION

Generally, a balance shaft module of a vehicle is installed in a lower part of a cylinder block of an engine in order to reduce vibration and noise of the engine. For example, as shown in FIG. 1, two balance shaft 2 are rotatably installed in a balance shaft housing 1, a gear or a sprocket 3 is formed at a front end of one balance shaft 2 to receive rotating power of the engine, and a plurality of oil discharge holes 1*a* are formed side by side in a lower part of balance shaft housing 1.

Further, a part of engine oil 5 held in an oil pan flows in balance shaft housing 1 as shown by a cross-section in FIG. 2 and engine oil 5 is suitably discharged outside of the balance shaft module through oil discharge holes 1*a* formed in an upper part of the balance shaft housing when balance shaft 2 rotates as shown by an arrow.

In the structure of the known balance shaft module, since oil discharge holes 1*a* are formed in an upright direction when the engine oil is discharged through the oil discharge holes by the balance shaft, the oil pumped by the balance shaft is discharged outside of the balance shaft module through the oil discharge holes and reflows in the balance shaft module through the oil discharge holes.

To address the above, as shown in FIG. 3, an oil guide 6 may be suitably installed so that the engine oil discharged through center oil discharge hole 1*a* is smoothly guided outside of the balance shaft module. The oil guide 6 interferes with a ladder frame 4 that is mounted on the upper part of the balance shaft module to suitably reduce the vibration and noise of the engine. In general, the oil guide 6 is not easy to install and the size of the balance shaft module increases.

The above information disclosed in this the Background section is only for enhancement of understanding of the background of the invention and therefore it may contain information that does not form the prior art that is already known in this country to a person of ordinary skill in the art.

SUMMARY OF THE INVENTION

In one aspect, the present invention provides an oil discharging structure of a balance shaft module that can smoothly discharge oil pumped by a balance shaft outside of the balance shaft module by forming an oil guide surface in a ladder frame that is preferably installed in an upper part of the balance shaft module.

Preferably, an oil discharging structure of a balance shaft module according to a preferred embodiment of the present invention includes a balance shaft housing that is rotatably supported with a balance shaft inserted therein; oil discharge holes that are suitably formed in the balance shaft housing so that oil in the balance shaft housing is suitably discharged to the outside by the balance shaft; and an oil guiding means that is preferably provided in a ladder frame mounted on an upper part of the balance shaft housing in order to suitably induce the oil discharged through the oil discharge holes to the outside of the balance shaft housing.

In one embodiment of the present invention, the oil guiding means is preferably provided on facing bottoms of the ladder frame positioned in an upper part of the oil discharge hole.

In another embodiment of the present invention, the oil guiding means preferably includes an oil guide surface having a curve shape, which guides the oil discharged through the oil discharge hole to the outside of the balance shaft housing.

In a further embodiment of the present invention, the ladder frame preferably includes a vertical frame having two long sides of a rectangular shape, which are suitably disposed side by side and a horizontal frame having a plurality of short sides interposed between the two vertical frames, and the oil guide surface is suitably formed on the bottom of the horizontal frame adjacent to the oil discharge hole among the plurality of horizontal frames.

Preferably, the horizontal frame has a center portion protruding to the oil discharge hole and the oil guide surface extends from the center portion to left and right sides.

Preferably, the oil discharge hole is formed in the balance shaft housing to form one pair of two holes adjacent to each other in a width direction and two pairs in a longitudinal direction, and the oil guide surface is suitably formed in two horizontal frames adjacent to the oil discharge hole at left and right sides around the center portion.

In another further embodiment of the present invention, by an oil discharging structure of a balance shaft module according to the present invention, a curve-shaped oil guide surface is suitably formed in a lower part of a ladder frame adjacent to oil discharge holes that are suitably formed adjacent to the balance shaft module, such that when engine oil in the balance shaft module is pumped by rotation of a balance shaft and is discharged outside of the balance shaft module through the oil discharge holes, an oil discharge direction is suitably changed by the oil guide surface, thereby smoothly discharging the engine oil.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other features of the present invention will now be described in detail with reference to certain exemplary embodiments thereof illustrated by the accompanying drawings which are given hereinafter by way of illustration only, and thus are not limitative of the present invention, and wherein.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

As described herein, the present invention includes an oil discharging structure of a balance shaft module, comprising a balance shaft housing, oil discharge holes, and an oil guiding means to induce the oil discharged through the oil discharge holes to the outside of the balance shaft housing.

In one embodiment, the balance shaft housing is rotatably supported with a balance shaft.

In another embodiment, the oil discharge holes are formed in the balance shaft housing so that oil in the balance shaft housing is discharged to the outside by the balance shaft.

In another further embodiment, the oil guiding means is provided in a ladder frame mounted on an upper part of the balance shaft housing in order to induce the oil discharged through the oil discharge holes to the outside of the balance shaft housing.

In one embodiment, the oil guiding means is provided on the bottom of the ladder frame positioned in an upper part of the oil discharge hole.

In another aspect, the invention features an oil discharging structure of a balance shaft module, comprising a balance shaft housing, a ladder frame, oil discharge holes, and an oil guiding portion to induce the oil discharged through the oil discharge holes to the outside of the balance shaft housing.

In one embodiment, the balance shaft housing is rotatably supported with a balance shaft.

In another embodiment, the ladder frame is mounted on an upper part of the balance shaft housing.

In another further embodiment, the oil discharge holes are formed in the balance shaft housing so that oil in the balance shaft housing is discharged to the outside by the balance shaft.

In one embodiment, the oil guiding portion is provided in the ladder frame to induce the oil discharged through the oil discharge holes to the outside of the balance shaft housing.

Figure 1:
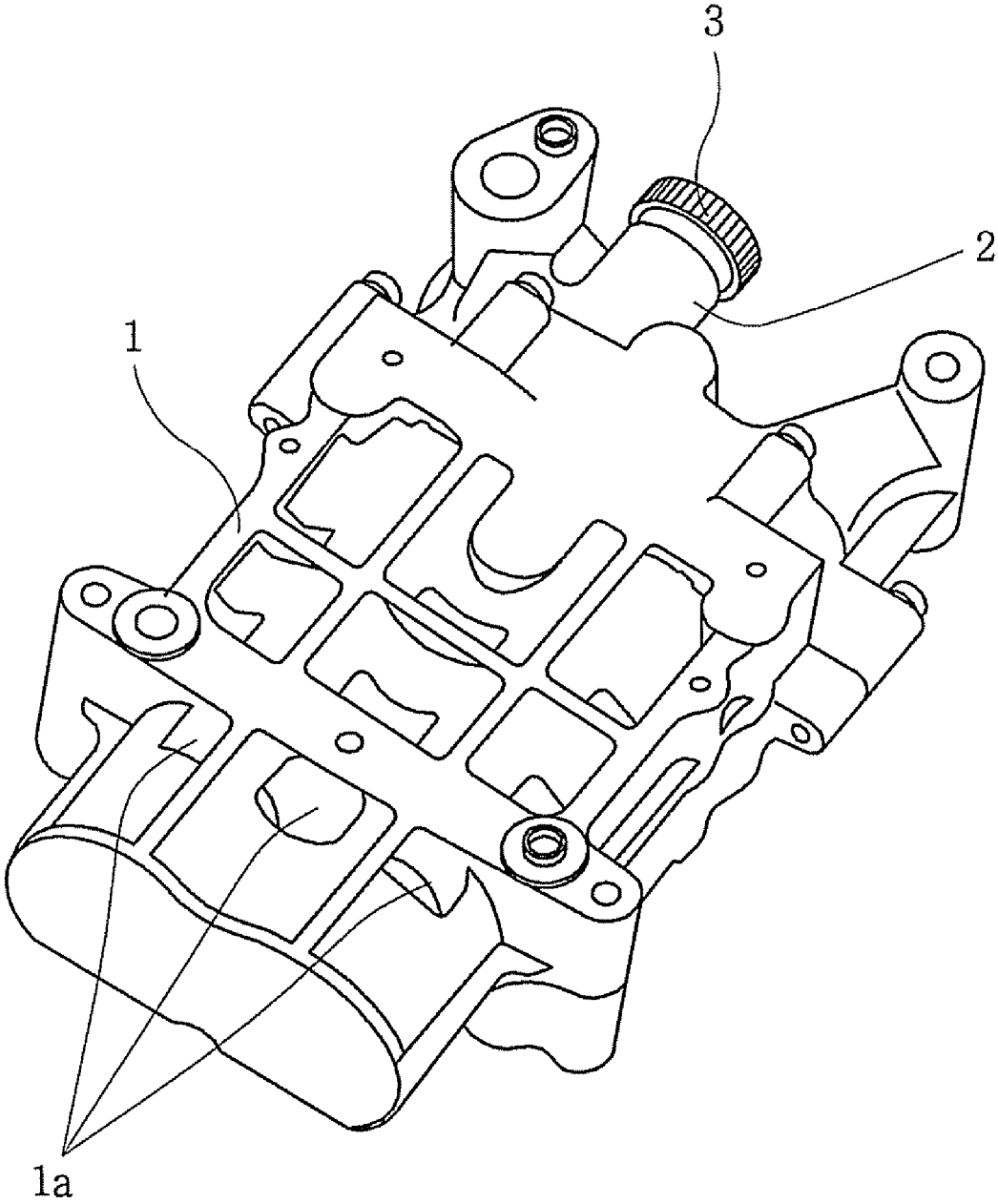
FIG.1 (Prior Art)
FIG. 1 is an exemplary perspective view of a balance shaft module in the prior art.
Figure 2:
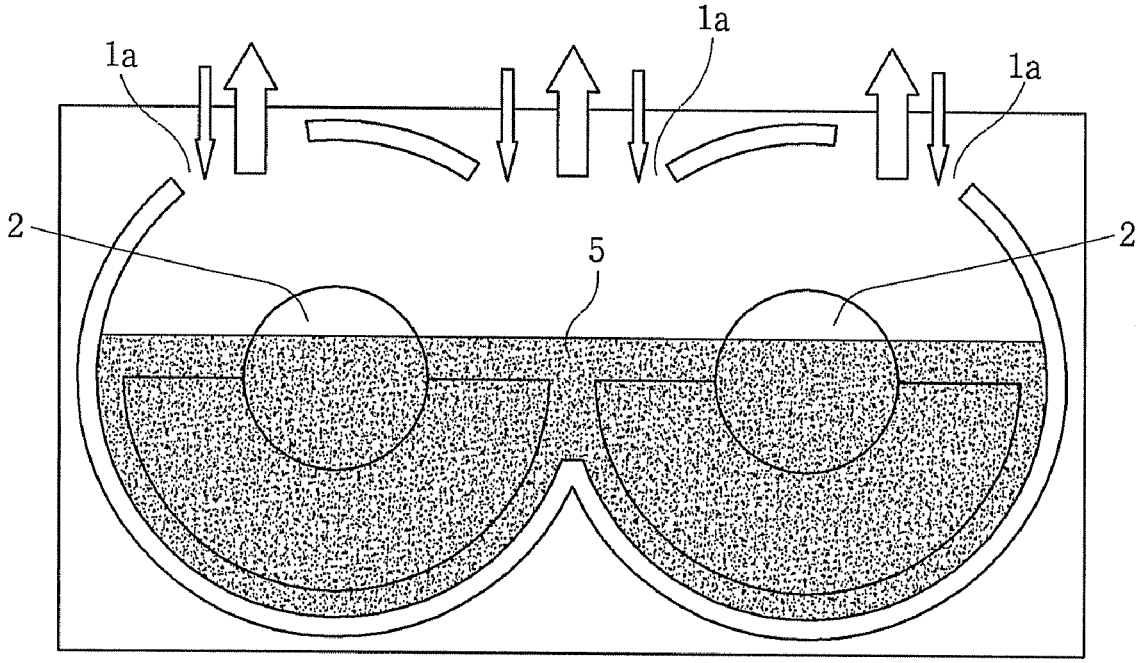
FIG.2 (Prior Art)
FIG. 2 is an exemplary cross-sectional view of oil discharge holes of a balance shaft module in the prior art.
Figure 3:
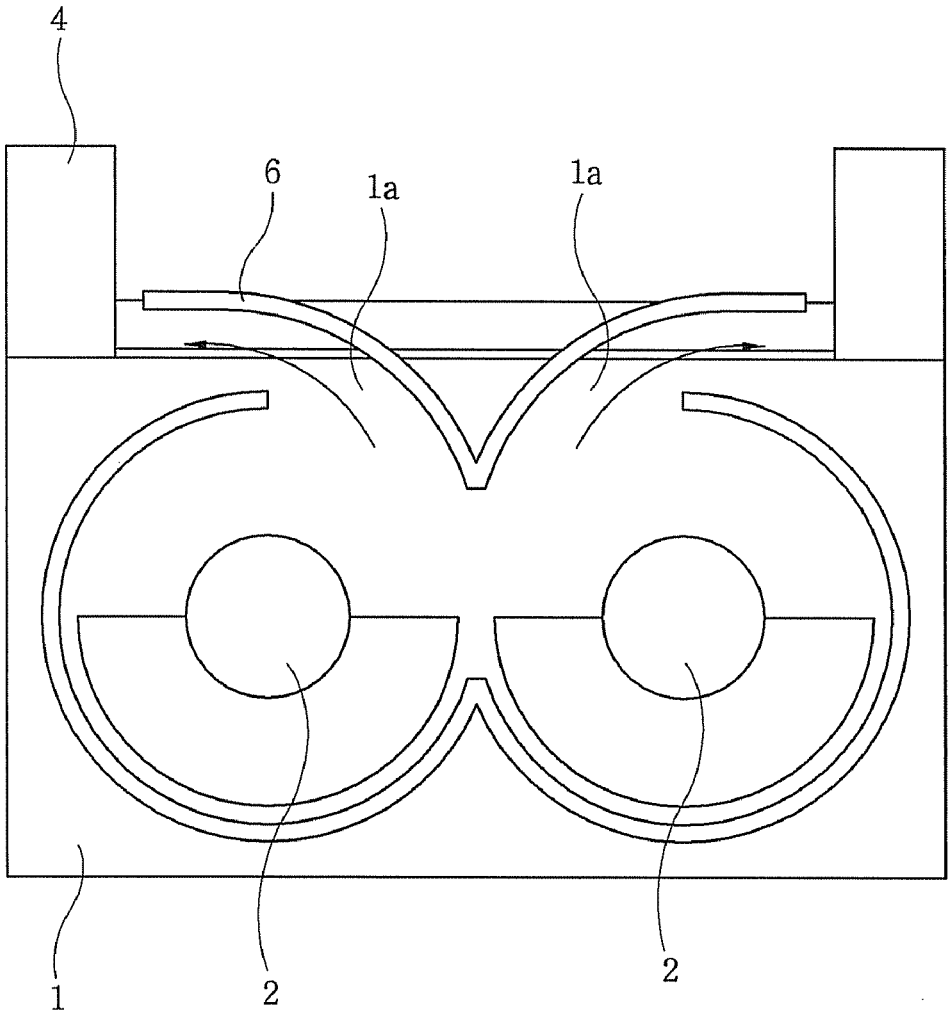
FIG.3 (Prior Art)
FIG. 3 is an exemplary cross-sectional view in which oil guides are suitably installed in oil discharge holes of a balance shaft module in the prior art.
Figure 4:
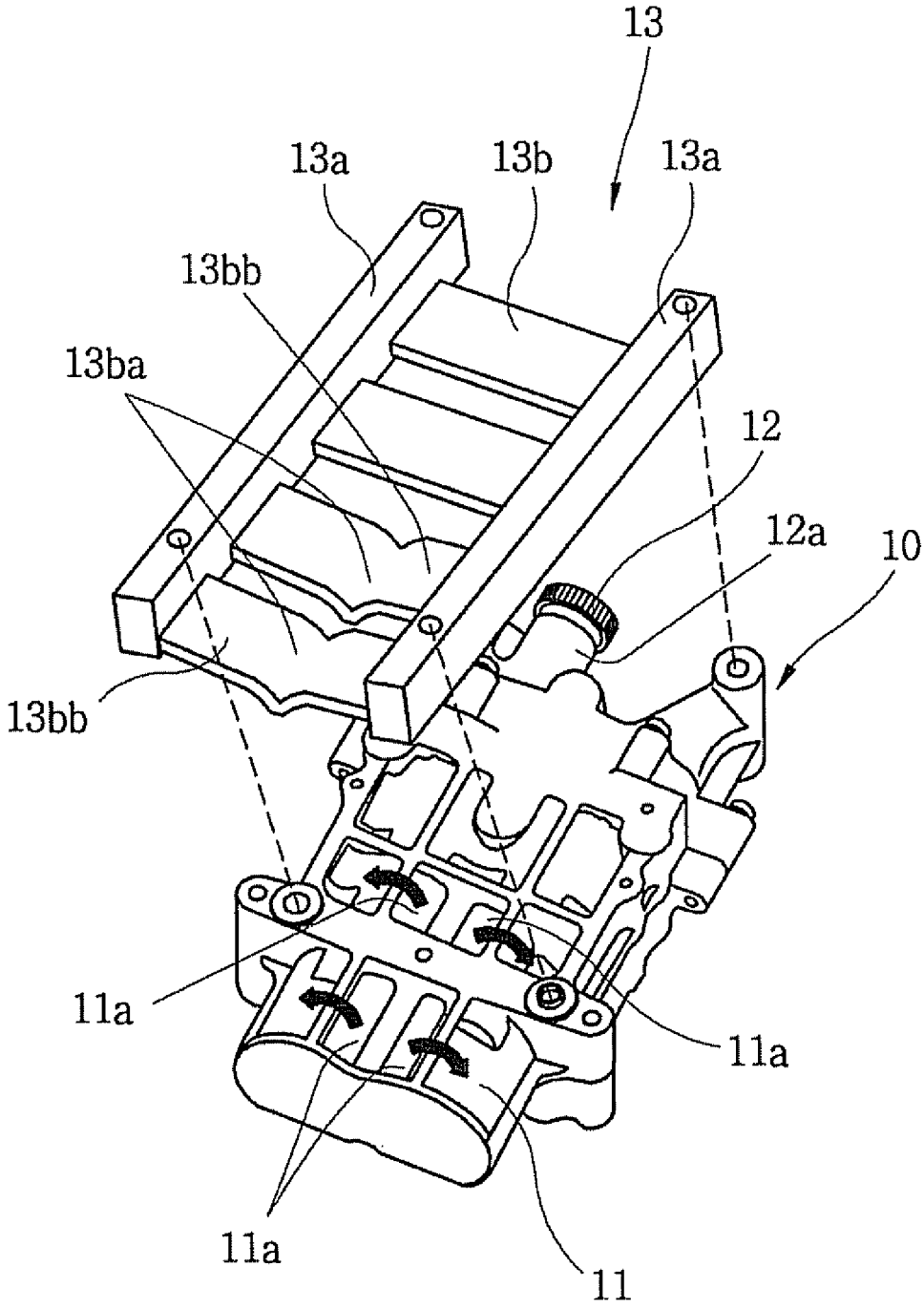
FIG. 4 is an exemplary exploded perspective view of a balance shaft module provided with an oil discharging structure and a ladder frame according to a preferred embodiment of the present invention.

In an exemplary embodiment of the present invention, referring to FIG. 4, for example, a balance shaft module 10 preferably includes a balance shaft housing 11 having a rectangular box shape and two balance shafts 12 that are suitably housed and rotatably installed in the housing.

In a further preferred embodiment, a gear or a sprocket 12*a* is formed in one balance shaft 12 so as to suitably receive rotating power of an engine and two pairs of oil discharge holes 11 a having a rectangular shape, and which are in communication with the inside of the housing and are, side by side, formed adjacent to each other in an upper part of balance shaft housing 11.

Further, a ladder frame 13 installed in a lower part of a cylinder block in order to reduce vibration and noise of an engine is suitably joined and mounted at rectangular edges of balance shaft housing 11 by bolts.

According to further preferred embodiments, a ladder frame 13 preferably includes a vertical frame 13*a* having two long sides having a suitably rectangular shape, which are disposed side by side and a horizontal frame 13*b* preferably having a plurality of short sides, which is suitably interposed between two vertical frames 13*a*.

Preferably, two horizontal frames 13*b* are suitably adjacent to two pairs of oil discharge holes 11*a*, respectively when the ladder frame is mounted on the upper part of the balance shaft module. Further, center portions 13*ba* of horizontal frames 13*b* adjacent to two pairs of oil discharge holes 11*a*, respectively, preferably protrude downward and extension surfaces suitably extended from the center portions to the outside form a curved oil guide surface 13*bb* as an oil guiding means.

Figure 5:
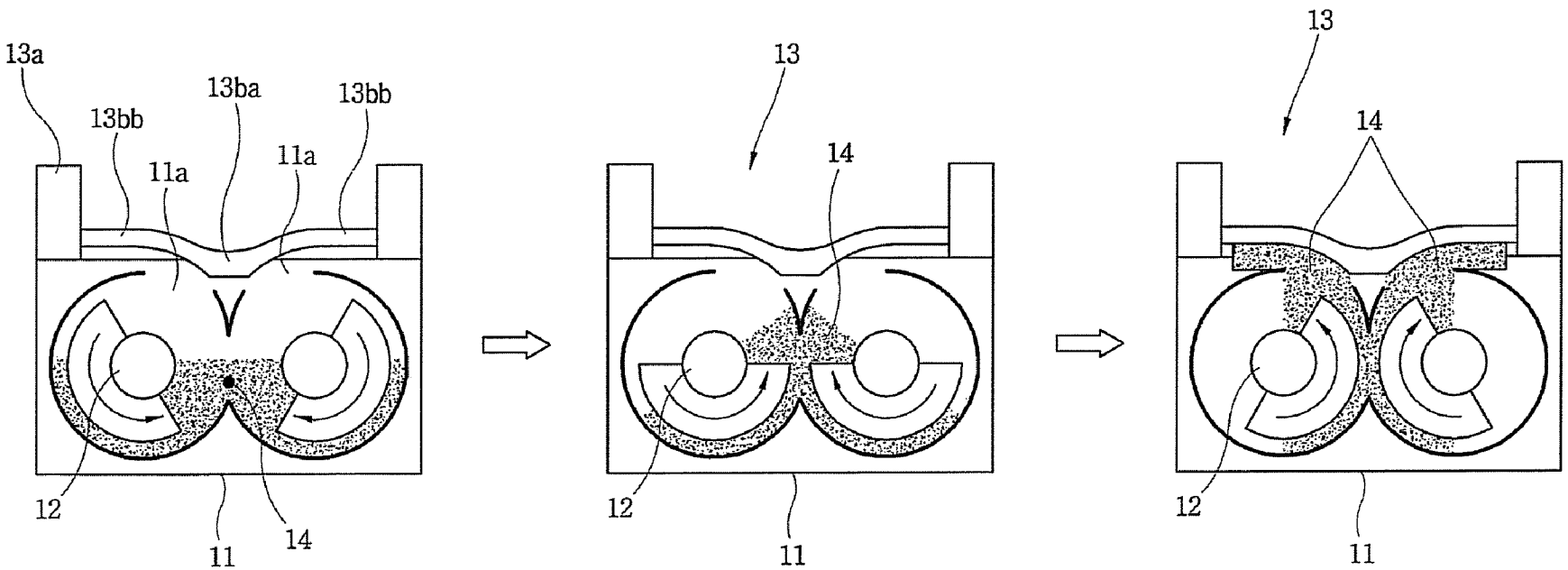
FIG. 5 is an exemplary cross-sectional view of an oil discharging structure according to a preferred embodiment of the present invention.

Accordingly, in further preferred embodiments, as a result, as shown by a cross-section in FIG. 5, when a ladder frame 13 is suitably mounted on the upper part of the balance shaft housing, two horizontal frames 13*b* are preferably positioned adjacent to oil discharge holes 11*a*, and two oil guide surfaces 13*bb* are suitably disposed at left and right sides, respectively, to be positioned in the upper part of the oil discharge holes while center portions 13*ba* of the horizontal frame are suitably positioned between two oil discharge holes.

Accordingly, in further preferred embodiments, when engine oil 14 is suitably pumped to the oil discharge holes by the balance shaft by rotation of balance shaft 12, the oil discharged to the outside through the oil discharge holes is smoothly discharged the outside of the balance shaft module while being switched from an upright direction to an included direction by the oil guide surface.

That is, preferably, according to further related embodiments, the oil discharged through the balance shaft oil discharge holes is smoothly discharged by being switched to a suitably diagonal direction without being discharged in the upright direction.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. An oil discharging structure of a balance shaft module, comprising:

a balance shaft housing that is rotatably supported with a balance shaft inserted therein;

oil discharge holes formed in the balance shaft housing so that oil in the balance shaft housing is discharged to the outside by the balance shaft; and an oil guiding portion that is provided in a ladder frame mounted on an upper part of the balance shaft housing in order to induce the oil discharged through the oil discharge holes to the outside of the balance shaft housing, wherein the ladder frame includes a vertical frame having two long sides of a rectangular shape, which are disposed side by side and a horizontal frame having a plurality of short sides interposed between the two vertical frames, and an oil guide surface is formed on a bottom of the horizontal frame adjacent to the oil discharge holes among the plurality of horizontal frames.

2. The structure as defined in claim 1, wherein the oil guiding portion is provided on facing bottoms of the ladder frame positioned in an upper part of the oil discharge holes.

3. The structure as defined in claim 1, wherein the oil guiding portion includes an oil guide surface having a curve shape, which guides the oil discharged through the oil discharge holes to the outside of the balance shaft housing.

4. The structure as defined in claim 1, wherein the horizontal frame has a center portion protruding to the oil discharge holes and the oil guide surface extends from the center portion to left and right sides.

5. The structure as defined in claim 4, wherein the oil discharge holes are formed in the balance shaft housing to form one pair of two holes adjacent to each other in a width direction and two pairs in a longitudinal direction, and the oil guide surface is formed in two horizontal frames adjacent to the oil discharge holes at left and right sides around the center portion.

6. An oil discharging structure of a balance shaft module, comprising:

a balance shaft housing that is rotatably supported with a balance shaft inserted therein;

a ladder frame mounted on an upper part of the balance shaft housing;

oil discharge holes formed in the balance shaft housing so that oil in the balance shaft housing is discharged to the outside by the balance shaft; and an oil guiding portion that is provided in the ladder frame in order to induce the oil discharged through the oil discharge holes to the outside of the balance shaft housing, wherein the ladder frame includes a vertical frame having two long sides of a rectangular shape, which are disposed side by side and a horizontal frame having a plurality of short sides interposed between the two vertical frames, and an oil guide surface is formed on a bottom of the horizontal frame adjacent to the oil discharge holes among the plurality of horizontal frames.

7. The structure as defined in claim 6, wherein the oil guiding portion is provided on facing bottoms of the ladder frame positioned in an upper part of each of oil discharge holes.

8. The structure as defined in claim 6, wherein the oil guiding portion includes an oil guide surface having a curve shape, which guides the oil discharged through the oil discharge holes to the outside of the balance shaft housing.

9. The structure as defined in claim 6, wherein the horizontal frame has a center portion protruding to the oil discharge holes and the oil guide surface extends from the center portion to left and right sides.

10. The structure as defined in claim 9, wherein the oil discharge holes are formed in the balance shaft housing to form one pair of two holes adjacent to each other in a width direction and two pairs in a longitudinal direction, and the oil guide surface is formed in two horizontal frames adjacent to the oil discharge holes at left and right sides around the center portion.

* * * * *